United States Patent [19]

West

[11] 4,200,198

[45] Apr. 29, 1980

[54] CAN TOP OPENER

[75] Inventor: Allen D. West, Catoosa, Okla.

[73] Assignee: Chinquapin Corporation, Catoosa, Okla.

[21] Appl. No.: 958,109

[22] Filed: Nov. 6, 1978

[51] Int. Cl.[2] ..... B65D 41/32

[52] U.S. Cl. ..... 220/269; 220/270; 220/271; 220/277

[58] Field of Search ..... 220/267, 268, 269, 277, 220/271

[56] References Cited

U.S. PATENT DOCUMENTS

| | | | |
|---|---|---|---|
| 4,073,403 | 2/1978 | Orange | 220/269 |
| 4,094,435 | 6/1978 | Kennedy | 220/269 |

*Primary Examiner*—George T. Hall

*Attorney, Agent, or Firm*—Head & Johnson

[57] ABSTRACT

An opener for a metal can having cylindrical sidewalls and a top panel, the panel including a pouring tab scored therein, an elongated opener strip having one end attached to the inner surface of the pad at a point adjacent the can sidewall and the other end attached to the inner surface of the top panel at a point adjacent the can sidewall diametrical of the tab, a pop hole scored in the top panel adjacent the center and directly over the opening strip, an opener stick normally lying parallel and contiguous with the can top panel, the opener stick having the inner end affixed to the pop hole tab and the pop hole tab being affixed to the opener strip intermediate its ends so that when the opener stick is pivoted upwardly, the pop hole tab is torn from the panel, providing an open aperture in the panel, following which the opener stick may be downwardly displaced into the can causing the opener strip to apply force on the pouring tab to tear at least portions of the periphery of the tab from the panel exposing a pouring opening.

6 Claims, 4 Drawing Figures

CAN TOP OPENER

BACKGROUND AND OBJECTS OF THE INVENTION

A common means of packaging and distributing beverages, including soft drinks, beer, and fruit juice, is the use of metal cans. The cans are typically formed of aluminum or steel. The cans are cylindrical with a top and bottom panel. When beverage cans were first introduced on the market, the can itself did not include an opening means, and to open the can, an external device was employed, such as a hand-held opener. To improve the convenience of cans, manufacturers have produced breakaway can openers which are integral with the can top panel and therefore do not require any supplementary opening apparatus. The most common type of integral can opener in use commercially today includes a tab scored in the top panel of the can and lift element attached to the scored tab. The lift element is commonly in the form of a ring attached at one end to the tab. When the ring is lifted up, portions of the tab are torn form the top panel and further force completely extracts the pouring tab from the can, leaving an exposed pouring opening. While such system works completely satisfactory as far as providing a pouring opening, a problem is created in disposal of the tabs. Most beaches, stream banks, and recreational areas of the United States are littered with the ring tabs, creating a nuisance. In addition, while cans are frequently recycled for their metallic content, particularly if they are aluminum cans, the tabs are discarded and do not become part of the recycle process.

To alleviate the problem of the detachable ring and tab, others have provided a double-hole pop tab opener can which solves the trash problem since neither of the tabs detach from the can. However, opening the tab is difficult. The holes formed in the cans may cut a finger and the danger exists of getting a finger stuck in a can hole. The old "church key" beer opener words very well but does not allow the convenience of the can carrying its own opener. Other types of openers have been provided which have attachments means so that the dislodged pouring tab is retained as a part of the can top panel; however, they provide upwardly extending protrusions which can cut the user and in general interfere with pleasant use of cans when the user drinks directly from the can.

The present invention is directed towards improvements of the existing type of cans including self-openers. An object of the present invention is to provide a self-contained opener for a can which has a pouring spout opening in which no portions of the tab forming the pouring spout extend above the top panel surface and in which all portions of the opening device remain integral with the can, thus eliminating the litter problem and saving the metal for recycling.

Another and more specific object of the invention is to provide an opening system for a metal can including an opening stick which forms an opening in the middle of the can in an arrangement wherein the opening stick may be then forced downwardly through the opening to pull a pouring tab adjacent the can's cylindrical sidewall to form a pouring opening through which contents of the can may be discharged or consumed directly by the user.

Other objects and advantages of the present invention over other types of self-opening cans are: (1) cans are opened very efficiently; (2) the system is adaptable to present manufacturing methods; (3) the opening method creates no detached trash; (4) the opener provides a clean pouring opening; (5) the opener avoids any projection that would irriate or injure the user; (6) the opener does not offer any danger to the user; (7) the opener avoids the need for a supplementary detached opening; and (8) the opener is convenient to use.

These general objects as well as other and more specific objects of the invention will be fulfilled in the following description and claims, taken in conjunction with the attached drawings.

SUMMARY OF THE INVENTION

An opening means is provided for a metal can having a cylindrical wall and a top panel, the opening being provided in the top panel. A pouring tab is scored in the top panel, the tab being outlined by reduced thickness metal. The pouring tab is positioned adjacent the can cylindrical sidewall and preferably is of generally triangular configuration oriented such that one point of the triangular shaped tab is adjacent the can cylindrical sidewall. An elongated opener strip is positioned on the interior of the top panel and has one end attached to the inner surface of the pouring tab. The other end of the strip is attached to the inner surface of the top panel at a point adjacent the can sidewall diametrically of the tab. A scored pop hole tab is formed in the panel outlined by reduced thickness metal, the pop hole tab being in the center of the panel and directly over the opener strip. An opener stick is positioned parallel the panel outer surface. The inner end of the opener stick is affixed to the top hole tab and the opener stick lies in the direction of and approximately the length of a radius of the panel. The inner surface of the pop hole tab is secured to the opener stick at a point intermediate the ends of the opener strip so that thereby the inner end of the opener stick, the pop hole tab, and the opener strip are all fastened together, which may be accomplished such as by the means of a rivet extending through these three elements. The can is opened by pivoting the opener stick uprightly, which causes the pop hole tab to tear loose from the panel providing a pop hole opening. The opener stick may then be pushed downwardly, causing the opener strip to tear the pouring tab from the cover and to hinge the pouring tab interiorly of the can to provide a pouring opening which may be used for discharging the contents of the can into another vessel for directly drinking from the can. When the pouring tab is fully opened, all portions of the pouring devices are within the interior of the can except the upper end of the opener stick and all portions remain integral and unattached from the can for disposal with the can.

Detailed Description

Figure 1:
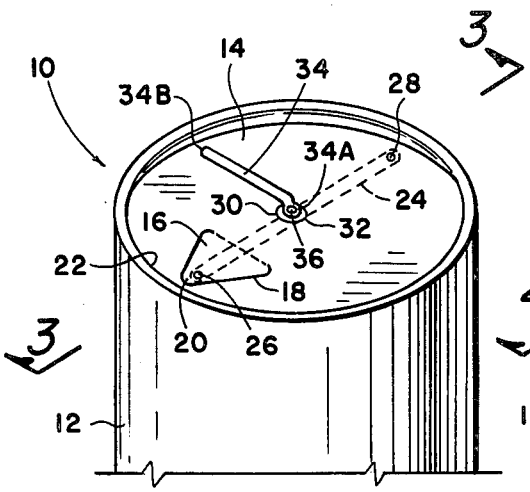
FIG. 1 is an isometric view of the upper portion of a cylindrical metal can showing the top panel and showing the elements of the present invention for providing a self-contained opener.
Figure 2:
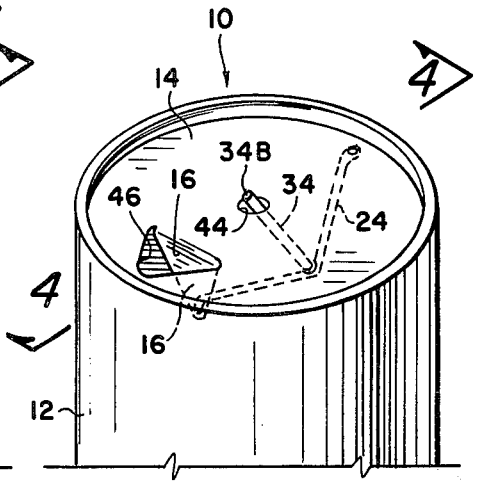
FIG. 2 is an isometric view as shown in FIG. 1 and showing the top panel of a can after a pouring opening has been formed in the can.

Referring to the drawings and first to FIG. 1, a can employing the principles of this invention is generally illustrated by the numeral 10. The can includes a sidewall 12 which is normally cylindrical. The can includes a top panel 14, which, when the sidewall 12 is cylindrical, is of a circular configuration and secured at its periphery to the can sidewall forming a leakproof closure. The purpose of this invention is to provide means of producing a pouring opening in the panel 14 in a manner such that all elements necessary to produce the pouring spout opening are integral with the can, both before and after the pouring spout opening is formed.

Formed in the panel 14 is a pouring tab 16 having upper surface 16A and lower surface 16B. The pouring tab is outlined by a scored groove of reduced thickness metal 18 in panel 14. The scored groove 18 may be in the upper surface only, or in the lower surface only, or preferably, partially in both the upper and lower surfaces. The function of the scored groove is to provide a line of reduced strength so that the tab 16 is normally retained in position to confine the contents of the can 10 during its normal handling, but to be easily torn from the panel 14 as will be described subsequently.

The shape of the pouring tab 16 as defined by groove 18 may vary, but a preferred arrangement includes that illustrated in which it is of general triangular configuration with one point 20 of the triangle adjacent the panel periphery 22. This arrangement is advantageous in that it makes the tab easier to tear from panel 14 and, in addition, provides a better configuration for pouring contents from the can.

An elongated opener strip 24 is positioned within the can 10 on the lower surface 16B of the cover. A first end 24A of the opener strip is attached to the pouring tab at a point adjacent the cover periphery 22. In the illustrated arrangement the end 24A of the opener strip is secured to tab 16 by means of a rivet 26 although it can be seen that instead of using a rivet, the end 24A of the opener strip may be attached such as by spot welding or other means.

The second end 24B of the opener strip is attached to the interior of the can at a point spaced from tab 16 and is preferably affixed to the inner surface 16B of the panel at a point adjacent the can sidewall 12 which is diametrical of the tab 16. The end 24B may be secured to the panel 16 by means of a rivet 28 or may be spot welded to it.

A pop hole tab 30 is formed in panel 14 and preferably in the center thereof, by means of a groove 32 scored in the panel. Groove 32 may be scored in the top surfaces 16A of the panel or in the bottom surface 16B, or as illustrated, in both the top and bottom surfaces to provide a circumferential line of weakness around the pop hole tab. The pop hole tab is directly over the opener strip 24.

Positioned on the exterior surface of panel 14 when the can is in the normal closed position is an opener stick 34 having an inner end 34A and an outer end 34B. The inner end of the pouring stick 34B is secured to the pop hole tab 30. In the illustrated arrangement, a rivet 36 extends through an opening 38 in the inner end of the opener stick, an opener 40 in the pop hole tab 30, and an opening 42 in the opener strip 24. This is an illustration of one arrangement wherein these three elements are secured together although it can be seen that these elements also may be bonded together such as by means of spot welding or other means. The opener strip 34 normally lies as a radius on the top surface of panel 14 and preferably extends perpendicular to the opener strip 24 as illustrated in FIG. 1.

OPERATION

When it is desired to open the can employing the invention, the opener stick 34 is grasped by the fingers of the user towards the outer end 34B. The opener strip is pivoted vertically upward to extend perpendicular of the panel 14. This upward movement causes the pop hole tab 30 to tear loose around the peripheral groove 32 so that the pop hole tab 30 is completely severed from panel 16. The opener stick, pop hole tab 30, and opener strip 24 remain secured to each other. Since the opener strip is long and narrow, it does not break loose from engagement with the pop hole tab; the opener strip merely flexes as the opener stick is pivoted.

With the pop hole tab 30 severed from the can top panel 14, a pop hole opener 42 is formed in the center of the panel 14 of a dimension determined by the groove 32 scored in the can. The opener stick 34 may then be pushed down into the interior of the can by finger pressure, the stick extending through the opening 44 until it is pushed substantially all the way down and the outer end 34B is even with or extends slightly above the pop hole opening 44. As the opener stick 34 is depressed, the opener strip 34 pulls pouring tab 16 downwardly into the interior of the can. More precisely, the opener strip 24 applies pressure to first tear the pouring tab 16 from the panel 14 in the area where the strip is attached to the pouring tab and as the opener stick 34 is further depressed, the tab 16 is torn along the groove 18 allowing the tab to bend down within the interior of the can. A portion of the groove 18 opposite point 20 may be scored less heavily, or not scored at all since it is not necessary that the pouring tab 16 be completely dislodged from panel 14. It is only necessary that the pouring tab be hinged downwardly to form pouring opening 44. It can be seen that when the pouring opening 46 is formed, all portions of the opening system remain integral with the can, and there is no tab or other element to be thrown away to clutter the environment. Further, all portions of the can remain with the can and are recycled with it, resulting in a decreased loss of natural resources.

One advantage of the opening system of this invention is that it provides the can with a pop hole opening 44 in addition to pouring opening 46. This means that a vent is provided so that fluid is more evenly discharged through the pouring opening 46 either when the can is utilized for pouring the contents into another vessel or for direct drinking of the contents by the user.

Figure 3:
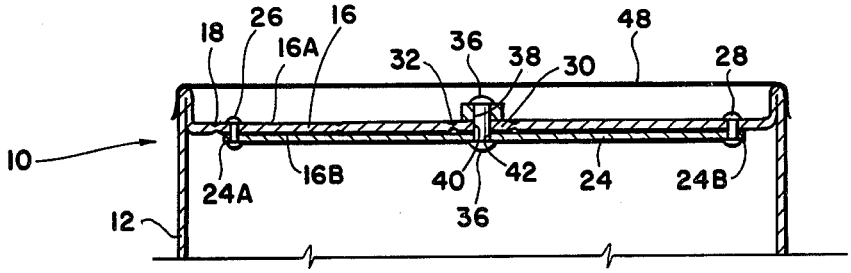
FIG. 3 is a cross-sectional view taken along the line 3—3 of FIG. 1, the FIGURE being enlarged to show more details of construction of the opener.
Figure 4:
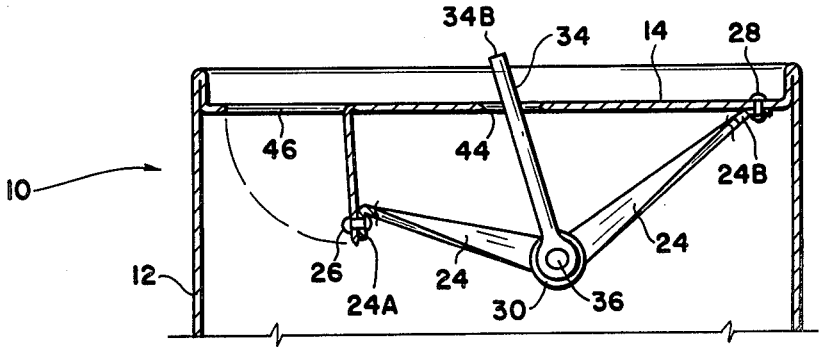
FIG. 4 is a cross-sectional view taken along the lines 4—4 of FIG. 2 and showing the arrangement of the elements after the can has been opened.

In order to preserve sanitation, the top surface of the can, including the top surface of the pouring tab and the top surface of the pop hole tab, plus the opener stick 34, may be protected by a plastic film 48 sealed around the can peripheral surface. (See FIG. 3). The user, when desiring to open the can, first removes the plastic film 48 and then follows the opening procedures above described.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. In combination with a metal container having a cylindrical sidewall and a top end panel, the panel having an inner and outer surface, an opening means comprising:

a pouring tab scored in the top panel outlined by reduced thickness metal, the tab being adjacent the cylindrical sidewall;

an elongated opener strip having one end attached to the inner surface of the pouring tab at a point adjacent the can sidewall and the other end of the strip attached to the inner surface of the top panel at a point adjacent the can sidewall diametrically of the tab;

a pop hole tab scored in the top panel outlined by reduced thickness metal, the pop hole tab being adjacent the center of the panel and directly above said opener strip and intermediate the strip ends; and an opener stick having the inner end affixed to the outer surface of said pop hole tab, the opener stick normally lying horizontally adjacent to the top panel outer surface with the outer end adjacent the cylindrical sidewall, whereby the opener stick may be pivoted upwardly tearing said pop hole tab from the top panel providing an open aperture in the top panel, following which the opening stick may be downwardly displaced so that the inner end engages said opener strip and further downward displacement of the opener stick causes portions of said scored periphery of said tab to be torn from the top panel and the pouring tab hinged downwardly within the container providing a pouring opener.

2. An opening means for a metal can according to claim 1 wherein said tab scored in the top panel is of generally triangular configuration, one point of the triangle being adjacent the can cylindrical sidewall, the side of the triangle opposite said point being adjacent said pop hole, the end of said opener strip being attached to the inner surface of said tab adjacent said point.

3. An opening means for a metal can according to claim 1 wherein said opener stick, said pop hole tab, and said opener strip are attached together.

4. An opening means for a metal can according to claim 3 wherein said pop hole tab, said opener stick at the inner end thereof, and said opener strip at a point intermediate the ends have aligned holes therein, and including:

a rivet positioned in the said three aligned holes securing the elements together.

5. An opening means according to claim 1 including:

a plastic film sealed over the can top panel.

6. In combination with a metal container having a sidewall and bottom and top end panels having inner and outer surfaces, an opening means for the top end panel, comprising:

a pouring tab in the top panel adjacent the can sidewall outlined at least in part by reduced thickness metal;

an opener strip having one end attached to the inner surface of the tab adjacent the can sidewall and the other end attached to the top panel interior at a point disposed away from said tab and adjacent the can sidewall diametrically of said pouring tab;

a pop hole tab scored in the top panel outlined by reduced thickness metal, the pop hole being positioned above said opener strip;

means of opening said pop hole;

and means extending through the pop hole to engage said opener strip intermediate its ends to cause at least part of said tab to be displaced into the container to provide a pouring opening.

* * * * *

UNITED STATES PATENT AND TRADEMARK OFFICE

CERTIFICATE OF CORRECTION

PATENT NO. : 4,200,198

DATED : April 29, 1980

INVENTOR(S) : ALLEN D. WEST

It is certified that error appears in the above-identified patent and that said Letters Patent are hereby corrected as shown below:

Column 2, line 49, change "top" to --pop--.

Column 3, line 63, change "34B" to --34A--.

Column 4, line 42, change "44" to --46--.

Column 4, line 22, change "42" to --44--.

Signed and Sealed this

*Fourteenth* Day of *October 1980*

[SEAL]

*Attest:*

SIDNEY A. DIAMOND

*Attesting Officer*

*Commissioner of Patents and Trademarks*